US005118103A

United States Patent [19]

Miller

[11] Patent Number: 5,118,103

[45] Date of Patent: Jun. 2, 1992

[54] COLLAPSIBLE PITCHING SCREEN

[76] Inventor: Michael P. Miller, 59391 Annah, New Hudson, Mich. 48165

[21] Appl. No.: 556,322

[22] Filed: Jul. 20, 1990

[51] Int. Cl.[5] ..... A63B 69/40

[52] U.S. Cl. ..... 273/26 A; 273/29 A; 273/181 F

[58] Field of Search ..... 273/26 A, 181 R, 181 A, 273/181 B, 181 F, 181 J, 181 K, 407, 410, 127 B, 25, 29 A, 392, 395

[56] References Cited

U.S. PATENT DOCUMENTS

| | | | |
|---|---|---|---|
| 3,013,801 | 12/1961 | Kirkconnell, Jr. | 273/26 A |
| 3,502,330 | 3/1970 | Cheftel | 273/395 |
| 3,633,909 | 1/1972 | Doynow | 273/26 A |
| 3,711,092 | 1/1973 | Hogue | 273/26 A |
| 3,836,144 | 9/1974 | Mahoney | 273/26 A |
| 4,082,271 | 4/1978 | Martin | 273/26 A |
| 4,160,549 | 7/1979 | Simpson | D73/29 A |
| 4,275,883 | 6/1981 | Grimaldi et al. | 273/26 A |
| 4,456,251 | 6/1984 | Balaz | D73/29 A |
| 4,489,941 | 12/1984 | Shieh | 273/407 |
| 4,629,188 | 12/1986 | Mahieu | 273/26 A |
| 4,693,472 | 9/1987 | Newman | 273/26 A |
| 4,702,478 | 10/1987 | Kruse | 273/410 |
| 4,718,668 | 1/1988 | Schipske | 273/26 A |
| 4,842,284 | 6/1989 | Rushing | 273/26 A |
| 4,863,166 | 9/1989 | Becera et al. | 273/26 A |
| 4,905,996 | 3/1990 | Tallent | 273/26 A |

FOREIGN PATENT DOCUMENTS

| | | | |
|---|---|---|---|
| 2562431 | 10/1985 | France | 273/29 A |

*Primary Examiner*—Theatrice Brown

*Attorney, Agent, or Firm*—Charles W. Chandler

[57] ABSTRACT

A portable screen adapted for positionment on a softball field to protect the pitcher from fast-moving batted balls. The screen includes a rigid rectangular frame that is formed by two slidably-connected U-shaped frame elements. Two laterally-spaced foot structures are hingedly connected to lower portions of the frame for supporting the frame in an upright position. The frame and foot structures can be collapsed and folded into a small size package for placement in the trunk of an automobile when it becomes necessary to transport the screen to or from a softball field.

7 Claims, 2 Drawing Sheets

COLLAPSIBLE PITCHING SCREEN

BACKGROUND AND SUMMARY OF THE INVENTION

Softball is placed on a field somewhat smaller than the field used to play baseball (hardball). Typically, the pitcher's mound on a softball field is only about forty-six feet from homeplate. The pitcher is relatively close to the batter, such that if the batter should hit a hard line drive directly at the pitcher, there is relatively little time for the pitcher to mentally react and physically move out of the path of the ball.

In some cases pitchers have been hurt by line drives. Accordingly, it has been proposed to provide a screen on the softball field in near vicinity to the pitcher's mound. The purpose is to have a protected zone in which the pitcher will be safe against being struck by a fast-moving, batted ball. The screen is located forward of the pitcher's mound but offset slightly from the ball trajectory (path) of the pitched ball. The protective screen does not interfere with the pitcher's delivery motion or the path of the pitched ball; however, the screen is near enough to the pitcher's mound that the pitcher can automatically stride into the space behind the screen as he completes his pitching motion. The pitcher can therefore deliver a fast pitch without fear of being struck by a fast-moving batted ball. The screen gives the pitcher peace of mind, as well as physical protection.

The present invention is directed to a collapsible protective screen usable on a softball field without being a permanent fixture on the field. The protective screen comprises a flexible net attached at its peripheral edge to a rectangular upright frame. Elongated ground-engageable feet extend from the lower edge of the frame for supporting the frame in an upright position on the field.

The protective screen is designed so that the frame can be collapsed into a relatively small size package for storage or transport. Also, the supporting foot structures are hingedly connected to the frame for fold-up against the frame. The aim is to achieve a collapsible screen structure that is sufficiently small to fit in the trunk of a person's car or in the rear portion of a small van.

In a typical structure the frame in its extended "use" position will have a height of about five feet and a width of about three feet. The foot structure extends rearwardly from the frame (along the ground surface) for a distance of about three feet. In its collapsed "storage-transport" condition, the frame has a height dimension of only about three feet. The width of the frame remains at three feet. The foot structures are folded against the frame so as to be parallel with the major plane of the frame. The thickness of the collapsed package is about six inches.

THE DRAWING

DESCRIPTION OF A PREFERRED EMBODIMENT OF THE INVENTION

Figure 1:
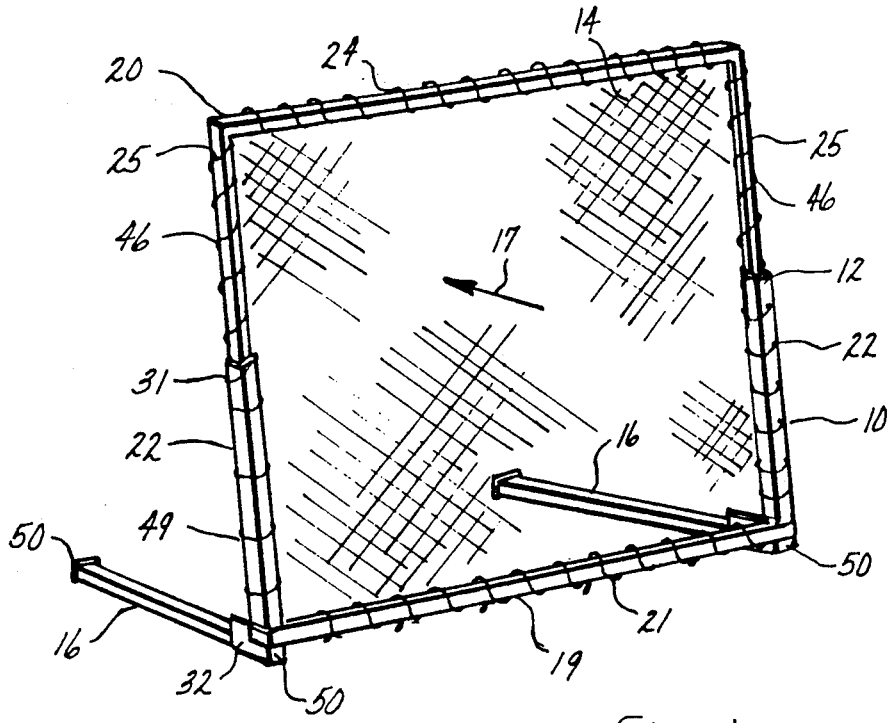
FIG. 1 is a perspective view of a protective screen constructed according to the invention.

FIG. 1 shows a protective screen 10 adapted for positionment on a softball field in near proximity to the pitcher's mound. In use, the screen offers protection to the pitcher from balls batted toward the mound. The screen will have a height of approximately five feet, such that the pitcher can peer over the screen while most of his body is protected by the screen.

Screen 10 comprises an upright rigid frame 12 surrounding a flexible net 14 formed of crossed strands or cords. The net is similar to the net used on tennis courts. Frame 12 is preferably formed out of aluminum or steel tubing. Two elongated tubular foot structures 16 extend angularly and rearwardly from the lower edge of frame 12 for supporting the frame in an upright position. Each foot structure extends along the ground surface behind the frame, i.e. away from the batter. FIG. 1 illustrates the screen substantially as it would be seen by the batter. A batted ball striking the screen will apply a force to the screen generally in the direction indicated by arrow 17. Foot structures 16 will maintain the screen in an upright condition in opposition to the arrow 17 force.

Figure 2:
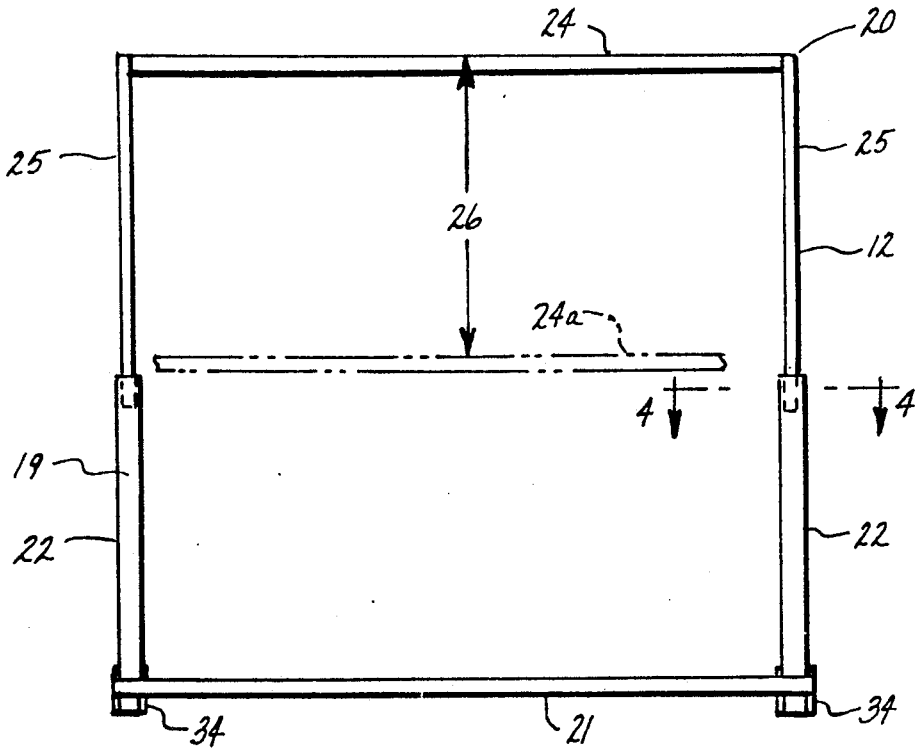
FIG. 2 is a front view of the FIG. 1 screen, with the net portion of the screen removed.

Frame 12 is designed as a collapsible structure so that it can be reduced in overall size for storage or transport in the trunk of an automobile. The frame comprises two U-shaped frame elements 19 and 20. Frame element 19 comprises a lower horizontal bar 21 and two upstanding tubular end members 22. Frame element 20 comprises an upper horizontal bar 24 and two downwardly extending tubular arms 25. These tubular arms are slidably and telescopically engaged with tubular end members 22, such that the two U-shaped frame elements can be moved to a collapsed condition in which the two bars 21 and 24 are relatively close together. FIG. 2 shows upper bar 24 in a dashed line position 24A representative of the collapsed condition of the frame. Dimension line 26 indicates the magnitude of movement of bar 24 when going from the extended position (full lines) to the collapsed position (dashed lines).

Figure 3:
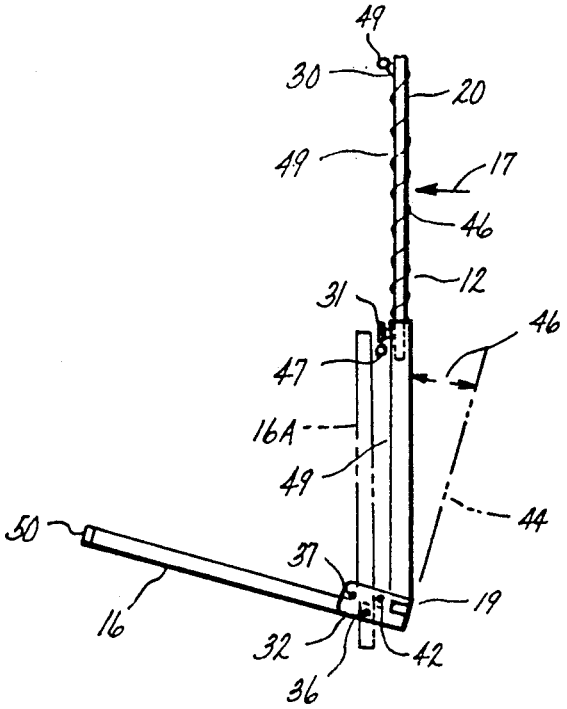
FIG. 3 is a side elevational view of the FIG. 1 screen, with foot structure portions of the screen shown in two different positions of adjustment.
Figure 4:
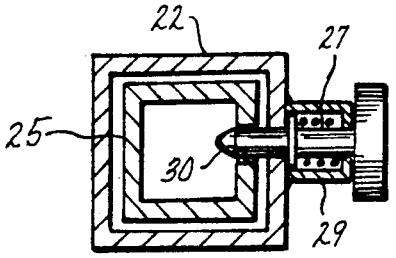
FIG. 4 is a fragmentary sectional view taken on line 4—4 in FIG. 2.

FIG. 4 shows one type of mechanism that can be used to retain frame elements 19 and 20 in their extended and collapsed conditions. The mechanism includes a spring-biased plunger 27 slidably mounted in a housing 29 for movement into a hole 30 in tubular arm 25. There are two holes 30 in each tubular arm. One hole is located near the upper end of the arm and one hole is located near the lower end of the arm. Each plunger 27 has a manual pull knob 31 for actuation purposes. Knobs 31 are preferably located on the rear faces of arms 22 (as shown in FIG. 3) where they are not likely to be struck by a batted ball, and where they do not project from the frame when the frame is collapsed.

Each foot structure 16 has a hinged connection 32 with the lower horizontal bar 21 of frame element 19, such that each foot structure can assume an extended position projecting away from the plane of frame 12 (as shown in full lines in FIG. 3) or a collapsed position in close parallel adjacency to end members 22 (dashed lines in FIG. 3). Each hinged connection 32 includes two parallel plates 34 extending in vertical planes normal to the major longitudinal axis of associated bar 21. Each foot structure 16 is a square cross-sectioned tube having one end thereof extending into the space between each set of parallel plates. A hinge pin 36 extends transversely through each foot structure tube and the associated plates 34.

Figure 6:
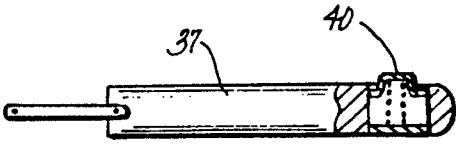
FIG. 6 illustrates a retainer pin that can be used in the FIG. 5 structure.

Each foot structure 16 is detained in its selected positions of adjustment (collapsed or extended) by means of a support pin 37. This pin is long enough to extend through two aligned openings in plates 34. A spring detente 40 (FIG. 6) is provided on one end of the pin to releasably retain the pin in place between the two plates. Pin 37 is located so that when the associated foot structure is in its extended position, the pin overlies the foot structure, thereby preventing the foot structure from hinging motion. After manual removal of pin 37 from plates 34, the foot structure can be moved to its collapsed position (dashed lines 16A in FIG. 3). A rod 42 extends between plates 34 to limit the forward motion of foot structure 16. Pin 37 can then be reinserted into the aligned openings in plates 34, such that the pin extends behind the foot structure tube to retain it in the collapsed condition.

It will be seen from FIG. 3 that when foot structures 16 are in their extended positions (full lines), they have an acute angular relationship to the plane of frame 12. An imaginary line 44 taken normal to tubular foot structures 16 will be at an acute angle 46 to the plane of frame 12. Angle 46 measures approximately fifteen degrees. Foot structures 16 and frame 12 will have an included angle of about seventy-five degrees when the foot structures are in their extended "use" positions. When foot structures 16 are seated flatwise on the ground surface, frame 12 extends upwardly and rearwardly (i.e. away from the batter). A batted ball striking screen 10 will apply a force in the arrow 17 direction. The ground will exert a reaction force on foot structures 16 tending to overturn the screen toward the batter's box (i.e. opposite in direction to the arrow 17 force). The rearward-upward tilt of frame 12 will keep the screen from overturning in most cases. The tilt built into the frame may also be beneficial as a stabilizing force under windy conditions.

Figure 5:
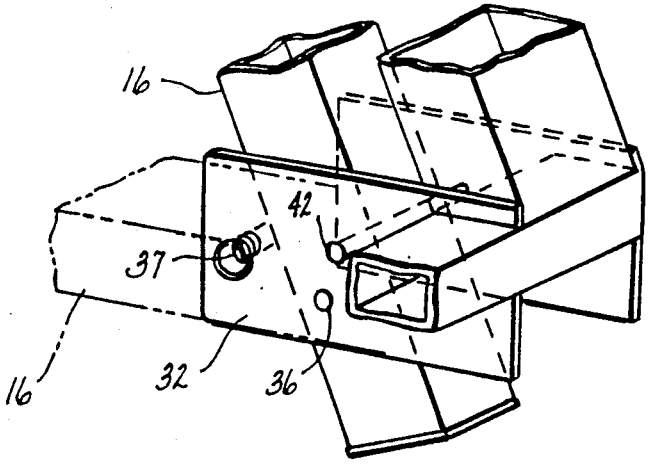
FIG. 5 is an enlarged fragmentary perspective view of a hinge structure used in the FIG. 1 screen.

It will be seen from FIGS. 3 and 5 that each hinge pin 36 is spaced from the free end of the associated foot structure 16. When foot structure 16 are in the ground-engaged positions they are in contact with the ground at points forwardly from the screen center of gravity, such that the screen is further stabilized against overturning. Lower bar 21 is spaced a slight distance above the ground surface. Bar 21 could be oriented with its lower face in the same plane as the lower edges of plates 34; however this might produce a wobbly support action on bumpy ground. Therefore it is preferred to locate bar 21 with its lower face spaced above the lower edges of plates 34, as shown in the drawings.

Plates 34 are vertically oriented at right angles to bar 21 so as to form a relatively strong hinge connection between the bar and the associated foot structure 16. Plates 34 have their planes extending parallel to force line 17, such that the plates take the force within their planes. The plates are not likely to bend or distort. Hinge pins 36 extend completely through each foot structure 16, with both ends of the pins being supported by plates 34. Each set of plates closely engage side surfaces of the associated foot structure tube 16, such that the foot structure is not likely to wobble. Plates 34 also serve as orienting structures for the associated tubular end members 22 when they are welded to bar 21; each member 22 has its end portion fitting snugly between the associated plates 34.

Net 14 is preferably connected to frame 12 at spaced discrete points along the frame, such that when the frame is moved between its extended position and its collapsed position, the net attachment points will offer no substantial resistance to frame movement. The net attachment mechanisms at bars 21, 22 and 24 are not too critical as regards frame movement; they can be individual rings or loops. However, the connections between the net and telescopic arm members 25 should preferably be detachable in nature. Preferably the net is connected to each arm 25 by means of a cord 46. Each cord 46 has one end thereof tied to an eyebolt 47 extending from an end member 22 near its upper end.

The other end of each cord 46 is tied to a second eyebolt 49 extending from an associated tubular arm 25 near its upper end; FIG. 3 illustrates the eyebolt locations. Each cord 46 is helically wound around a tubular arm 25 and peripheral areas of net 14, thereby anchoring the net to arm 25. Cord 46 is duplicated at each arm 25.

When it is desired to adjust frame 12 to its collapsed condition (with bar 24 lowered to dashed line position **24*a*) each cord 46 is first untied from eyebolt 49 and then unwound from around tubular arm 25. The two cords 46 may be extended back and forth between the two eyebolts 47 when frame 12** is in its collapsed condition.

Figure 7:
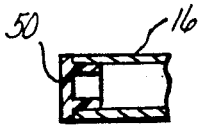
FIG. 7 is a sectional view of an end cap structure that can be used to close the ends of tubular elements used in the FIG. 1 protective screen.

In order to improve the appearance of the protective screen structure, and also to prevent dirt from migrating into tubes 16, each tube 16 can have a plastic plug-like cap 50 frictionally fitted into its opposite ends, as shown generally in FIG. 7. The caps are retained in place by frictional forces.

The illustrated screen assembly was designed especially for use on a softball field as a device to protect the pitcher against fast-moving batted balls. However, it is believed that the screen could serve other purposes, e.g. as a golf ball interception device, similar to the device shown in U.S. Pat. No. 4,063,739, or as a football interception device usable by placekickers when warming up on the sidelines, or as a miniature practice goal used by ice hockey players or soccer players during practice.

A primary feature of the invention is the fold-up nature of frame 12 and foot structures 16 whereby the protective screen can be converted to a small size package for transport in the trunk of a car. The drawings necessarily show one specific form of the invention. It will be appreciated that the invention can be practiced in other forms.

What is claimed is:

1. A screen structure adapted for temporary positionment on the ground of a sports field, comprising:

a collapsible rectangular frame that includes a first U-shaped frame element comprising a first lower horizontal bar and two parallel elongated upstanding end members extending right angularly from said lower horizontal bar, and a second, inverted U-shaped frame element comprising an upper horizontal bar and two parallel arms extending downwardly therefrom; said upstanding end members and said downwardly extending arms being slidably and telescopically engaged; said frame element being collapsible from a first, expanded condition wherein said second horizontal bar is relatively far away from said first horizontal bar, to a second, collapsed condition wherein said second horizontal bar is relatively close to said first horizontal bar, means for releasably retaining said frame elements either in the expanded condition or the collapsed condition;

a flexible net having peripheral edge areas thereof attached to said collapsible frame;

two laterally spaced foot structures hingedly connected to the lower horizontal bar of the first U-shaped frame element; each foot structure having a collapsed position extending parallel to one of the upstanding end members of the first U-shaped frame element, and a second extended position extending at an angle of about seventy-five degrees to the associated upstanding end member; and means for releasably detaining the foot structures either in their collapsed positions or their extended positions;

each foot structure comprising an elongated tube extending right angularly from the lower horizontal bar; said screen structure further comprising two parallel plates extending right angularly from the lower horizontal bar alongside each foot structure tube, and a hinge pin extending transversely through each foot structure tube and the associated parallel plates;

said detaining means comprising a pin extending across the space between each two parallel plates; each of said pins being located to overlie an associated foot structure tube when the foot structure is in its extended position, each of said pins being adapted to extend behind the associated foot structure tube when the foot structure is in its collapsed position; and said screen structure being positionable on a sports field so that the foot structures extend along the ground surface and the frame extends upwardly from the ground surface, with the plane of the frame extending at an angle of about seventy-five degrees to the ground engagement plane of the foot structures.

2. The screen structure of claim 1, wherein each of said upstanding end members extends into the space between said two parallel plates; said parallel plates being connected to each of the end members to orient the associated end member relative to the lower bar.

3. The screen structure of claim 1, wherein each said pin is removable from the associated parallel plates to permit the associated foot structure to be moved between its extended position and its collapsed position.

4. The screen structure of claim 1, wherein the parallel plates extend in vertical planes at right angles to the major axis of the lower horizontal bar; each parallel plate having a lower edge in horizontal alignment with the lower surface of the associated foot structure tube when the foot structure is in its extended position.

5. The screen structure of claim 1, and further comprising means for detachably connecting said flexible net to said parallel arms at spaced points along said arms; said connecting means being detachable from the net whereby the U-shaped frame elements can be moved between the expanded condition and the collapsed condition without resistance from the connecting means.

6. The screen structure of claim 5, wherein said connecting means comprises a flexible cord adapted to be helically wound around an associated tubular arm and a peripheral edge area of the net.

7. A screen structure adapted for temporary positionment on the ground of a sports field comprising:

a collapsible rectangular frame that includes a first U-shaped frame element comprising a first lower horizontal bar and two parallel elongated upstanding end members extending right angularly from said bar, and a second inverted U-shaped frame element comprising a second upper horizontal bar and two parallel arms extending downwardly therefrom; said upstanding end members and said downwardly extending arms being slidably and telescopically engaged; said frame elements being collapsible from a first expanded condition wherein said second horizontal bar is relatively far away from said first horizontal bar to a second collapsed condition wherein said second horizontal bar is relatively close to said first horizontal bar; means for releasably retaining said frame elements in the expanded condition or the collapsed condition;

a flexible net having peripheral edge area thereof attached to said collapsible frame;

two laterally spaced foot structures hingedly connected to the lower horizontal bar of the first U-shaped frame element; each foot structure having a collapsed position extending parallel to one of the upstanding end members of the first U-shaped frame element, and a second extended position extending at an angle of about 75 degrees to the associated upstanding end member; and means for releasably detaining the foot structures in their collapsed positions or their extended positions;

said screen structure being positionable on a sports field so that the foot structures extend along the ground surface and the frame extends upwardly from the ground surface, with the plane of the frame extending at an angle of about 75 degrees to he ground engagement plane of the foot structures;

each foot structure being an elongated tube extending right angularly from the lower horizontal bar; said screen structure further comprising two parallel plates extending right angularly from the lower horizontal bar alongside each foot structure tube and the associated parallel plates; and each of said upstanding end members extending into the space between said two parallel plates; said parallel plates being connected to each of the end members to orient the associated end member relative to the lower bar.

* * * * *